US009025807B2

(12) United States Patent
Gebert et al.

(10) Patent No.: US 9,025,807 B2
(45) Date of Patent: May 5, 2015

(54) COUPLABLE HEARING APPARATUS FOR A HEARING DEVICE, COUPLING ELEMENT AND HEARING DEVICE

(71) Applicant: Siemens Medical Instruments Pte. Ltd., Singapore (SG)

(72) Inventors: Anton Gebert, Kleinsendelbach (DE); Thomas Harsch, Hallerndorf (DE); Marco Lederer, Hirschaid/Erlach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 14/024,849

(22) Filed: Sep. 12, 2013

(65) Prior Publication Data

US 2014/0072165 A1 Mar. 13, 2014

(30) Foreign Application Priority Data

Sep. 12, 2012 (DE) ..... 10 2012 216 176
Nov. 21, 2012 (DE) ..... 10 2012 221 233

(51) Int. Cl.
*H04R 25/00* (2006.01)
*H04R 1/10* (2006.01)

(52) U.S. Cl.
CPC ..... *H04R 1/1058* (2013.01)

(58) Field of Classification Search
USPC ..... 381/309, 322, 325, 326, 328, 330, 380, 381/381, 382; 181/129, 130, 135; 128/864, 128/865, 867
See application file for complete search history.

(56) References Cited

U.S. PATENT DOCUMENTS

| | | | | |
|---|---|---|---|---|
| 7,844,065 | B2 * | 11/2010 | von Dombrowski et al. | 381/330 |
| 2003/0002700 | A1 * | 1/2003 | Fretz et al. | 381/330 |
| 2008/0152178 | A1 * | 6/2008 | Topholm et al. | 381/330 |
| 2013/0114839 | A1 | 5/2013 | Gebert | |

FOREIGN PATENT DOCUMENTS

| | | | |
|---|---|---|---|
| WO | 2012007193 | A1 | 1/2012 |
| WO | 2012113462 | A1 | 8/2012 |

* cited by examiner

*Primary Examiner* — Huyen D Le
(74) *Attorney, Agent, or Firm* — Laurence A. Greenberg; Werner H. Stemer; Ralph E. Locher

(57) ABSTRACT

A hearing apparatus includes a sound tube with a tube-side coupling element and an earpiece with an earpiece-side coupling element. The tube-side coupling element and the earpiece-side coupling element can be reversibly coupled. The tube-side coupling element has a tube-side pressure canal and the earpiece-side coupling element has an earpiece-side pressure canal, which form a coupled pressure canal in a coupled state of the coupling elements. The tube-side coupling element or the earpiece-side coupling element is supported by at least one pressure element which improves air-tightness of the coupled pressure canal. A coupling element and a hearing device are also provided.

18 Claims, 8 Drawing Sheets

COUPLABLE HEARING APPARATUS FOR A HEARING DEVICE, COUPLING ELEMENT AND HEARING DEVICE

CROSS-REFERENCE TO RELATED APPLICATION

This application claims the priority, under 35 U.S.C. §119, of German Patent Applications DE 10 2012 216 176.7, filed Sep. 12, 2012 and DE 10 2012 221 233.7, filed Nov. 21, 2012; the prior applications are herewith incorporated by reference in their entirety.

BACKGROUND OF THE INVENTION

Field of the Invention

The invention relates to a hearing apparatus for a hearing device unit, including a sound tube with a tube-side coupling element and an earpiece with an earpiece-side coupling element. The tube-side coupling element and the earpiece-side coupling element can be reversibly coupled. The tube-side coupling element has a tube-side pressure canal and the earpiece-side coupling element has an earpiece-side pressure canal, which form a coupled pressure canal in a coupled state of the coupling elements. The invention also relates to a coupling element and a hearing device. The term hearing device unit as used herein refers to any sound-emitting device which can be worn in or on the ear or on the head, such as a hearing device, headset, headphones and the like.

Hearing devices are wearable hearing apparatuses, which serve to assist people with hearing difficulties. In order to accommodate numerous individual requirements, various types of hearing devices are available such as behind-the-ear (BTE) hearing devices, hearing devices with external receiver (RIC: receiver in the canal) and in-the-ear (ITE) hearing devices, for example concha hearing devices or completely-in-the-canal (ITE, CIC) hearing devices. Those hearing devices listed by way of example are worn on the outer ear or in the auditory canal. Bone conduction hearing aids, implantable hearing aids and vibrotactile hearing aids are also available on the market. Damaged hearing is stimulated either mechanically or electrically with those devices.

In many of the hearing devices mentioned by way of example, the acoustic signal is conducted from a loudspeaker or receiver to an earpiece by using a sound tube. In an in-ear loudspeaker the loudspeaker is affixed not in the hearing device unit but in the earpiece. Such a loudspeaker is connected directly to the earpiece and is introduced into the auditory canal together therewith.

There are two particularly important aspects of the connection between the earpiece on one hand and the sound tube or the in-ear loudspeaker on the other. Firstly, the earpiece must be attached firmly enough so that it can be removed from the auditory canal again together with the sound tube or the in-ear loudspeaker. Secondly, the earpiece must however be easy for a user to detach in order to clean it. A connection that satisfies both of those criteria is referred to herein as a couplable connection.

In that context it is known for an earpiece to be connected to a sound tube or an in-ear loudspeaker by using a snap-on connection. The earpiece is then shaped so that it can, for example, be pushed onto a connection element of a sound tube and snapped into place there. Depending on whether an otoplastic made of a hard plastic, a flexible earpiece, e.g. a so-called dome, or a variable-volume earpiece, e.g. an inflatable in-ear balloon, is to be affixed, a suitably shaped connection element must be provided on the sound tube side or the in-ear loudspeaker side.

When using a variable-volume earpiece a pressure canal must, for example, be routed from a pump to a variable-volume element, i.e. for example the in-ear balloon of the earpiece, in order to pump it up with air or another medium.

The pump can be disposed in the hearing device unit on an ear-side end of the sound tube. It is also possible to position the pump in the earpiece itself. A conventional loudspeaker, known as a receiver, used in hearing devices can be used as a pump.

One problem with such devices is the sealing of the pressure canal in the case of a couplable connection between the sound tube and the earpiece.

SUMMARY OF THE INVENTION

It is accordingly an object of the invention to provide a couplable hearing apparatus for a hearing device, a coupling element and a hearing device, which overcome the hereinafore-mentioned disadvantages of the heretofore-known apparatuses, elements and devices of this general type and which seal the pressure canal in the region of a coupling between a sound tube and an earpiece sufficiently that an improved operation of a variable-volume earpiece is made possible, by improving the sealing of the coupling.

With the foregoing and other objects in view there is provided, in accordance with the invention, a hearing apparatus for a hearing device unit, comprising a sound tube with a tube-side coupling element, and an earpiece with an earpiece-side coupling element. The tube-side coupling element and the earpiece-side coupling element can preferably be coupled and decoupled in a force-locking and/or form-locking manner. Furthermore, the tube-side coupling element has a tube-side pressure canal and the earpiece-side coupling element has an earpiece-side pressure canal which when the coupling elements are coupled, form a coupled pressure canal. The tube-side coupling element or the earpiece-side coupling element have at least one pressure element which supports, assists or promotes air-tightness of the coupled pressure canal. A force-locking connection is one which connects two elements together by force external to the elements, as opposed to a form-locking connection which is provided by the shapes of the elements themselves.

The pressure element is a component which supplies pressure in the form of clamping pressure or bonding pressure or else expansion pressure. It is preferably annular in configuration. For example, it may be a sealing ring or expansion ring made of metal or hard plastic. Furthermore, the pressure element can be integrated into the tube-side coupling element or the earpiece-side coupling element, depending on whether it is constructed as a clamping pressure element or an expansion pressure element, in other words to generate bonding pressure. In alternative embodiments one of the clamping elements can itself also be a pressure element or perform the function of the pressure element.

The pressure canal can be any type of opening, including small drill-holes, grooves or punched-out sections, through which air, another gas or a fluid can flow. Although the sound tube is also a pressure canal by this definition, it is separated from the actual pressure canal and is in principle provided for sound propagation. The pressure canal is preferably provided to supply and discharge pumped air.

In one embodiment, the tube-side pressure canal is embodied in the form of at least two merging drill-holes. Two cylindrical drill-holes merge at any predetermined angle, so that they link up to form one canal. The merging of the drill-holes allows the pressure canal to have different curvatures or bends, based on the angle chosen.

In a further embodiment, the earpiece-side pressure canal is configured at least in part by using a circumferential groove. In a largely radially symmetrical earpiece, which is to be coupled flexibly and rotatably to the sound tube, this represents an elegant solution. A drill-hole is provided on the sound tube from the tube-side pressure canal, and in the coupled state corresponds to the circumferential groove in the earpiece-side pressure canal. Thus, in every rotational position of the earpiece relative to the coupling on the sound tube the circumferential groove can be charged with pressure, e.g. air pressure, as part of a coupled pressure canal. One or more drill-holes on the earpiece-side coupling element can now connect the circumferential groove to a further section, e.g. an in-ear balloon. Consequently, this in-ear balloon can be supplied with pressure through the pressure canal in any rotational position of the earpiece on the coupled sound tube.

Preferably, the sound tube and the earpiece each have a sound canal which is separated from the respective pressure canals acoustically and in air-tight fashion. In this way no mutual interference occurs.

In another embodiment, the tube-side coupling element and the earpiece-side coupling element can be coupled by using a luer or a luer lock. This entails a coupling connection which is proven and widespread in medical engineering.

In an alternative embodiment of the hearing apparatus, the tube-side coupling element and/or the earpiece-side coupling element themselves perform an additional function as a pressure element. This supports, assists or promotes air-tightness of the coupled pressure canal. Both coupling elements in this case are configured to be sleeve-shaped or tube-shaped and are adapted to one another in such a way that, for example, the earpiece-side coupling element can be pushed onto the tube-side coupling element. The tolerances of the dimensions to one another are chosen in such a way that a contact pressure of the coupling elements to one another arises in the coupled state. In this way the coupling elements are connected in a force-locking manner. In other words, for example, in the coupled state the earpiece-side coupling element presses onto the tube-side coupling element in such a way that a slippage of the coupling elements relative to one another is possible only by the effect of external force. Thus, at least one of the coupling elements additionally acts as a pressure element onto the other coupling element. This improves air-tightness in the region of the coupled pressure canal.

In another embodiment, the tube-side coupling element and the earpiece-side coupling element are coupled by using a clip connection in a form-locking manner. Such clip connections provide that one of the coupling elements has a groove in which a projecting sprung section of the other coupling element can latch. Clipping in the sprung section and the associated latching prevents lateral slippage of the coupling elements relative to one another. Since the sprung section also presses against the earpiece-side coupling element due to its sprung effect, an improved sealing of the coupled pressure canal is additionally achieved. In this embodiment the tube-side coupling element thus performs an additional function as a pressure element.

Other features which are considered as characteristic for the invention are set forth in the appended claims.

Although the invention is illustrated and described herein as embodied in couplable hearing apparatus for a hearing device, a coupling element and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
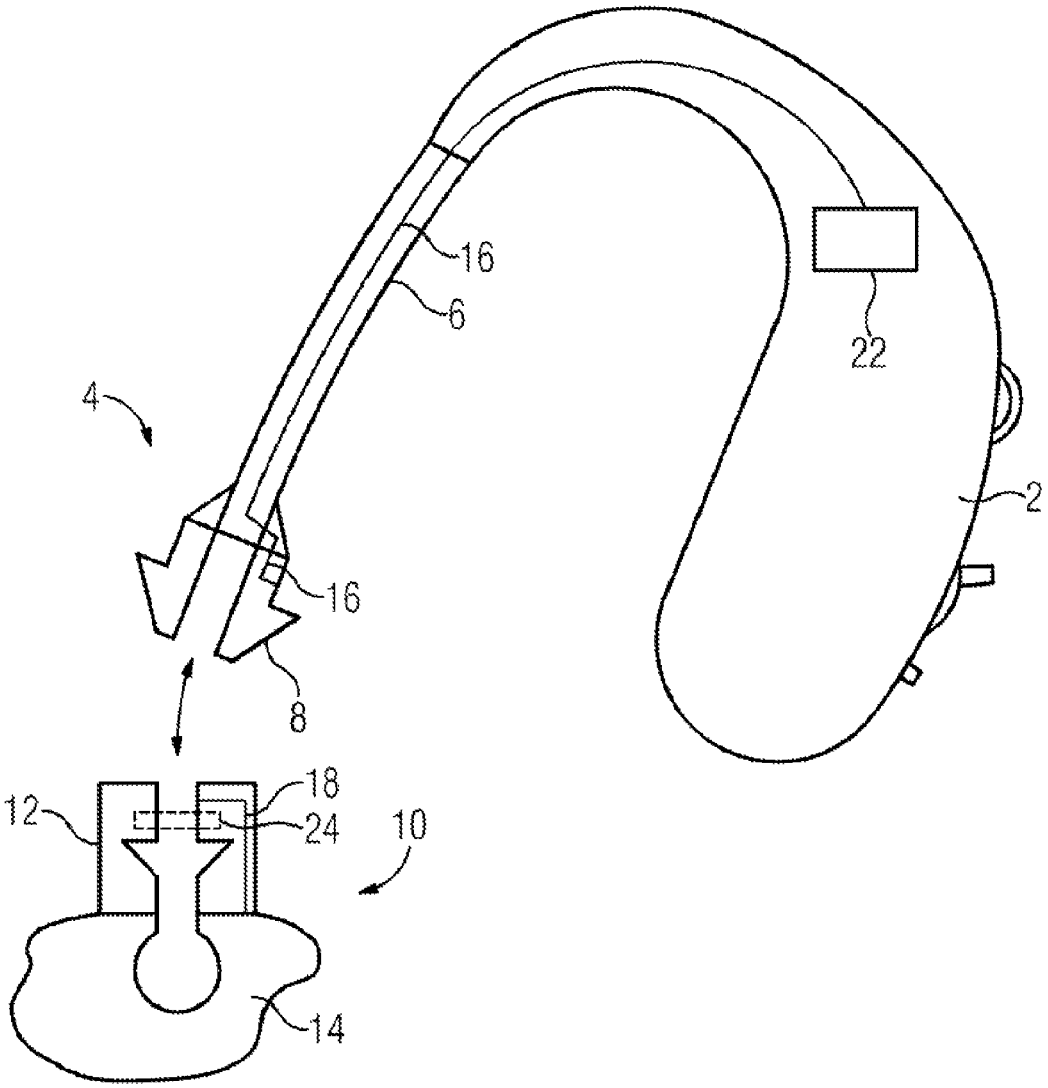
FIG. 1 is a diagrammatic, plan view of a hearing device unit with a hearing apparatus.

Referring now in detail to the figures of the drawings, which show different embodiments that explicitly do not represent a definitive limitation to the embodiments described and noting that further different embodiments are possible, and first, particularly, to FIG. 1 thereof, there is seen an embodiment of a hearing device unit 2 with a hearing apparatus 4. A sound tube 6 leads from the hearing device unit 2 to a tube-side coupling element 8. An earpiece 10, including among other things an earpiece-side coupling element 12, can be reversibly coupled to the tube-side coupling element 8. The term reversibly couplable means that, for example, a clamping connection or plug connection is provided, which can be freely connected and disconnected again. Such connections are usually configured to be force-locking and/or form-locking. In this embodiment the coupling is represented by using a plug mechanism with a barbed hook. This represents just one of many coupling options, such as for example a bayonet fitting, a screw fitting, a luer connection, a clip fitting, etc. Preferably, the coupling mechanism is configured in such a way that a user can perform the coupling and decoupling himself or herself manually.

A tube-side pressure canal 16 and an earpiece-side pressure canal 18 are respectively integrated into the tube-side coupling element 8 and into the earpiece-side coupling element 12. Both of these pressure canals have openings in their coupling region which correspond there to one another at least in part. In this way, the tube-side coupling element 8 and the earpiece-side coupling element 12 form a coupled pressure canal 20 (indicated in FIGS. 2-6) when coupled.

A variable-volume element 14 is affixed to the earpiece 10. In this embodiment the variable-volume element 14 is configured as a balloon or in-ear balloon. The variable-volume element 14 is in direct contact with an opening in the earpiece-side pressure canal 18. The volume of the variable-volume element 14 can be influenced in the coupled state by using a pump system 22. As shown, the pump system 22 can be integrated into the hearing device unit 2 and from there it can be connected to the tube-side pressure canal 20. Alternatively, the pump system 22 can also be disposed directly in or in the vicinity of the tube-side coupling element 8.

The pump system 22 conveys a medium such as air or another gas along one of two directions of the coupled pressure canal 20. Thus, the pump system 22 enables the variable-volume element 14 in contact therewith to be inflated or deflated. The volume can be affected to the extent that limits such as, for example, the maximum expandability of the material used or the thickness of an ear canal into which it can be inserted permit this.

A pressure element 24 is used to assist the coupling of the coupled pressure canal 20. In this embodiment this pressure element 24 is a metal ring which is integrated into the earpiece 10 and which exerts a certain clamping force. The strength of the pressure force or clamping force depends on the material and dimensioning of the pressure element 24.

If the earpiece 10 with the earpiece-side coupling element 12 is plugged onto or coupled to the tube-side coupling element 8, the coupled pressure canal 20 is also created. In some cases, depending on manufacturing tolerances or other basic conditions, it may be possible that the coupling point is not wholly air-tight. Thus, a medium pumped by the pump system 22 could undesirably leak at this point. In order to prevent this, the pressure element 24 clamps the two coupling elements, and thus also the coupling point of the coupled pressure canal 20, more firmly together than the coupling elements alone would. This results in an improved sealing of the coupled pressure canal 20.

Furthermore, the tightness of the coupling point of the coupled pressure canal 20 may depend, among other things, on the choice of material for the earpiece-side coupling element 12 and the tube-side coupling element 8. Materials with a softer surface such as rubber or plastics, for example, may seal this coupling better than materials with a harder surface such as metals, for example. Furthermore, a minimum surface smoothness is advantageous.

Figure 2:
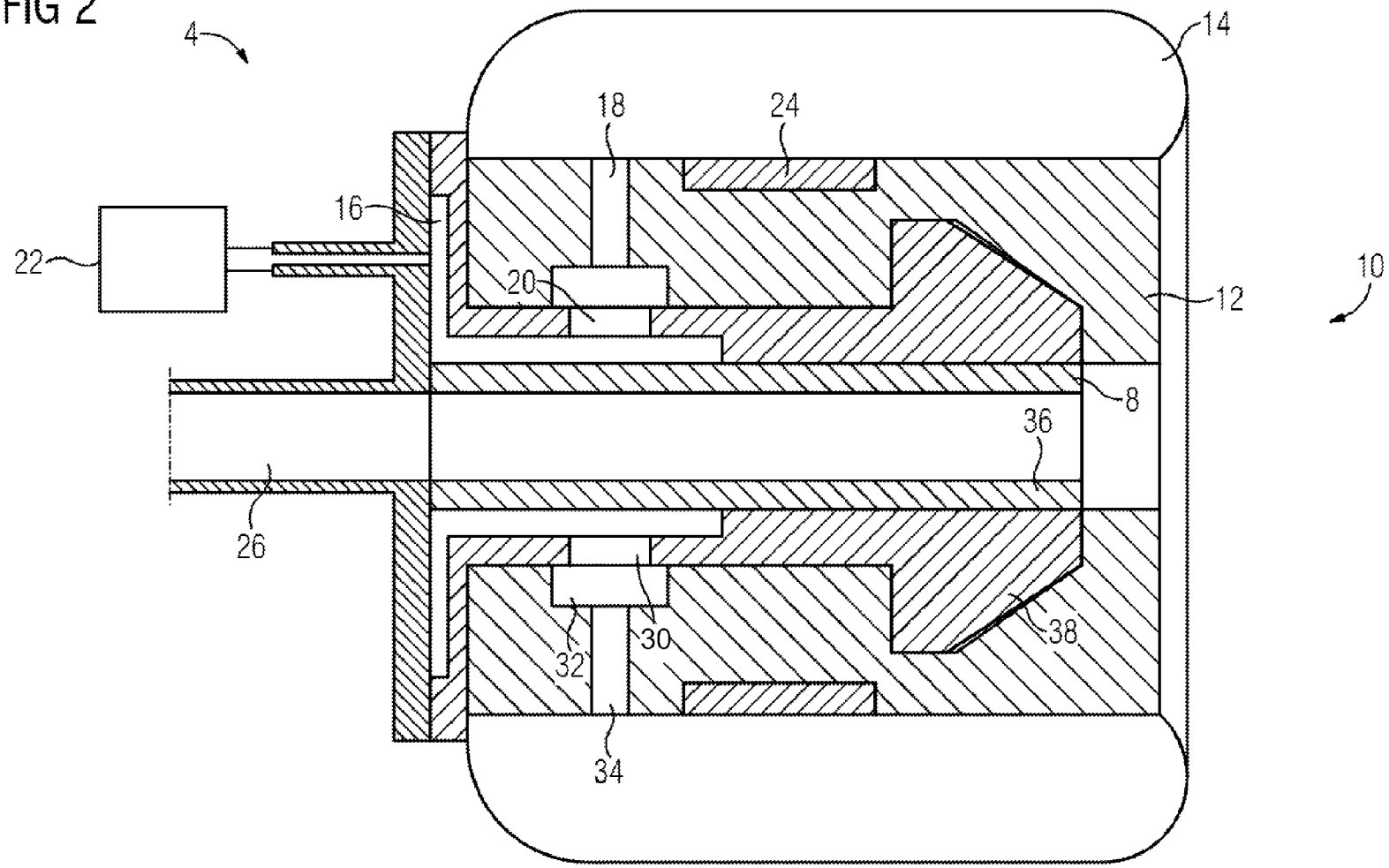
FIG. 2 is an enlarged, cross-sectional view of a hearing apparatus.

FIG. 2 shows a sectional view of an alternative embodiment of the hearing apparatus 4 in a coupled state. The coupling is effected in a force-locking and form-locking manner, resulting from the structural configuration of the tube-side coupling element 8 and the earpiece-side coupling element 12. Firstly, the two coupling elements latch together as shown. In addition, the earpiece-side coupling element 12 presses and clamps the tube-side coupling element 8 together. This clamping force is amplified by the pressure element 24. In this embodiment the pressure element 24 is incorporated into the earpiece 10 as a clamping metal ring.

In this way air-tightness of the coupled pressure canal 20, composed of the tube-side pressure canal 16 and the earpiece-side pressure canal 18, is assisted and improved. The coupled pressure canal 20 is constructed to be separate from a sound canal 26.

In the earpiece 10, the earpiece-side pressure canal 18 includes a circumferential groove 32 and at least one drill-hole 34 which connects the circumferential groove 32 to an internal region of the variable-volume element 14.

In this embodiment, the tube-side coupling element 16 is formed from at least two components, namely an inner component 36 and an outer component 38. These components can, for example, be glued together. However, other types of connection are also possible. Due to this differential construction a section of the tube-side pressure canal 16 can be created by assembling the components as constructed, without this pressure canal section having to be introduced separately by using an additional drill-hole. At least one drill-hole 30 for the connection of all of the pressure canal sections is provided at the outer component 38.

Preferably, the inner component 36 is manufactured from a metal, for example brass. In this way a drill-hole in the sound canal 26 can have a smaller diameter and the thickness of the wall can be less than in the case of a material which is less stable than metal. Further preferably, the outer component 38 is manufactured from a plastic material such as a rubber, for example. In this way the coupling of the coupled pressure canal 20 can be well sealed, because it involves a material with a relatively soft surface.

Due to the construction described, the earpiece 10 can be manufactured largely radially symmetrically. It can thus be rotated freely around the tube-side coupling element 8 during the coupled state and a completely uninterrupted, coupled pressure canal 20 extending from the pump system 22 to the variable-volume element 14 is guaranteed.

Figure 3:
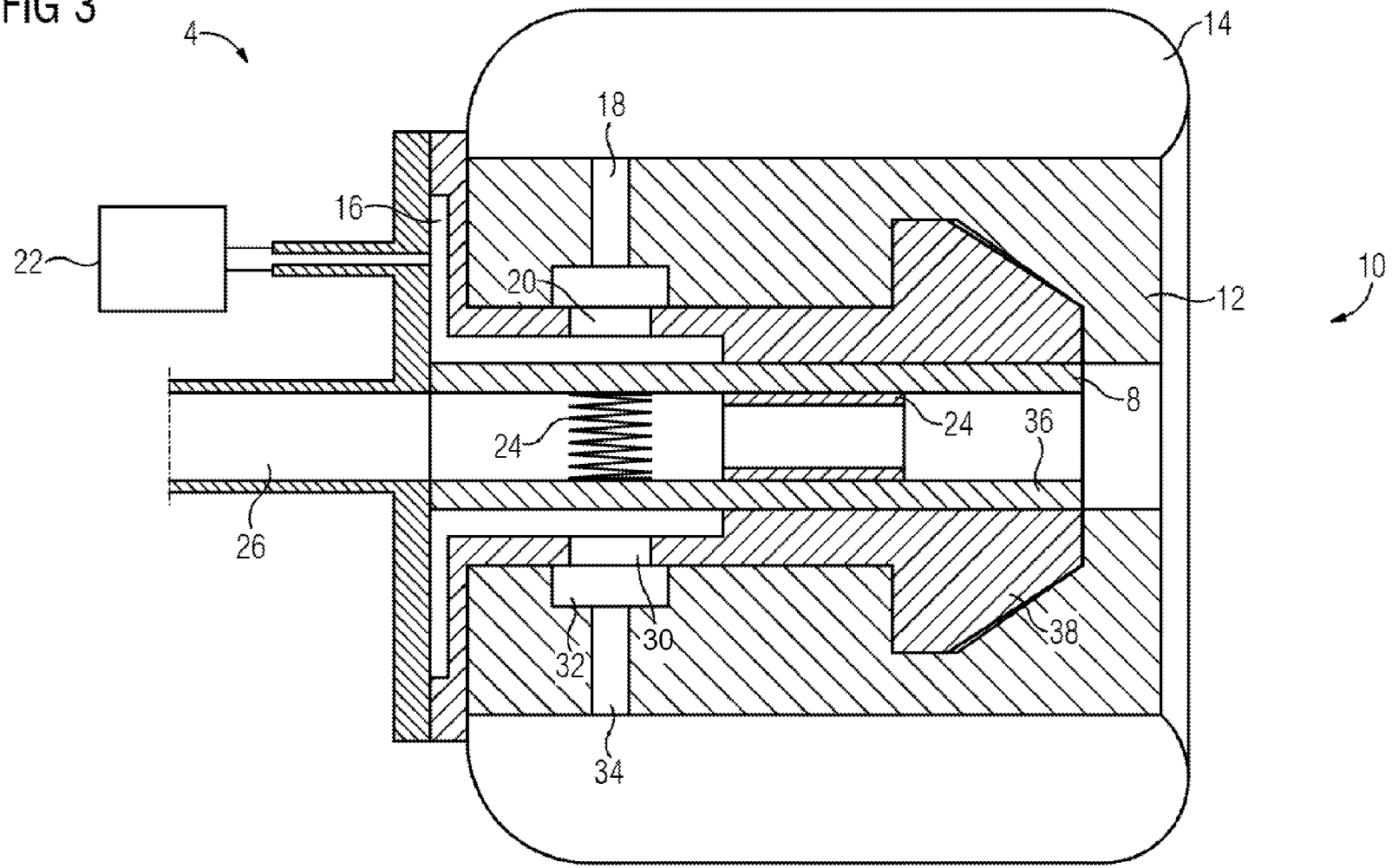
FIG. 3 is a cross-sectional view of another embodiment of a hearing apparatus.

FIG. 3 primarily shows alternative embodiments of the pressure element 24. Instead of being shown as a clamping ring, the pressure element 24 is once shown as a pressure spring in the sound canal 26 and once as an expansion ring on the tube-side coupling element 8. Both variants generate an expansion pressure onto the tube-side coupling element 8, which in a coupled state overlaps the earpiece-side coupling element 12 and thus assists the sealing of the coupled pressure canal 20.

Figure 4:
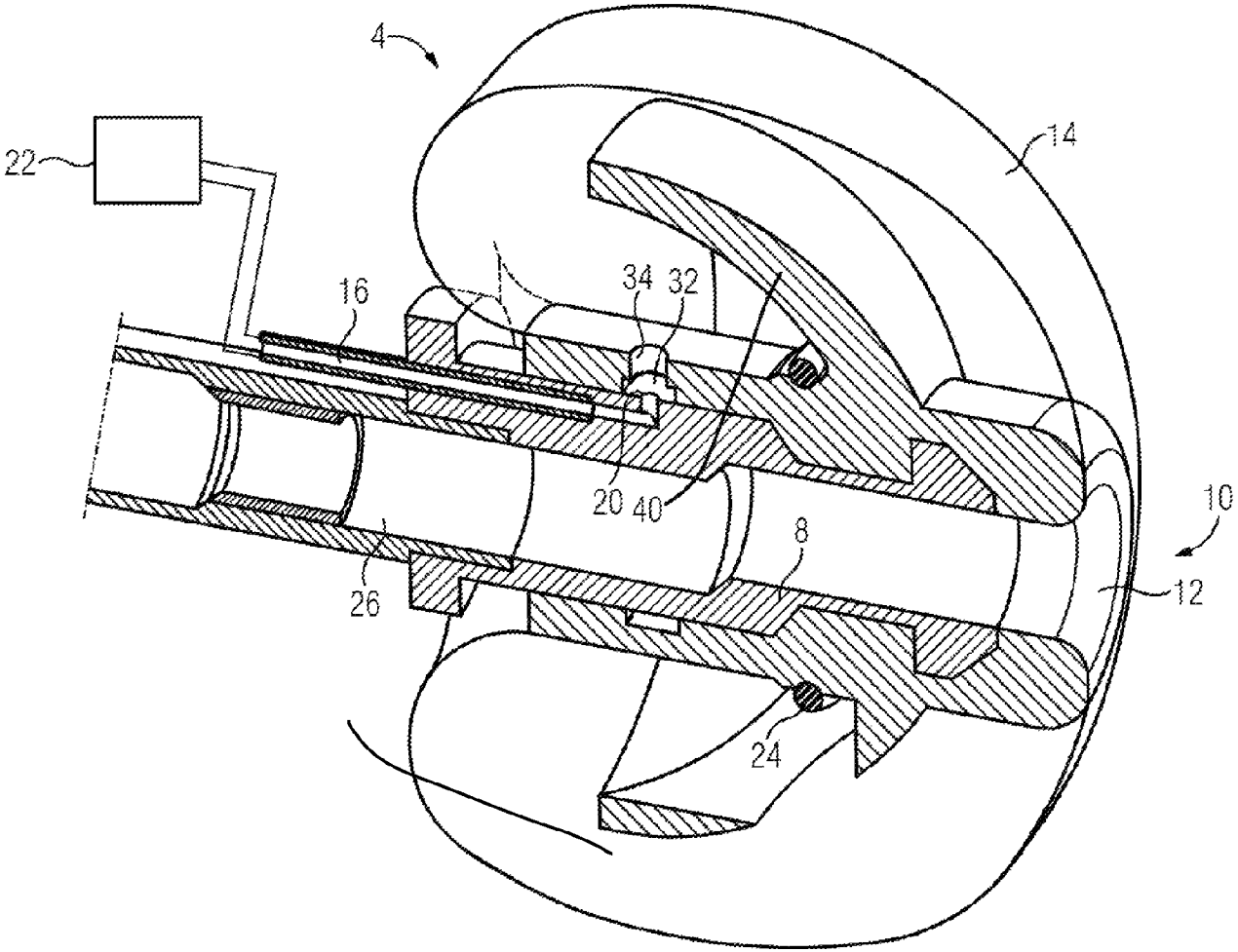
FIG. 4 is a partly broken-away, perspective view of a further embodiment of a hearing apparatus.

The broken-away, perspective view of FIG. 4 shows a further embodiment of the hearing apparatus 4. The circumferential groove 32 and the drill-hole 34 form the earpiece-side pressure canal 18 on the earpiece-side coupling element 12. The earpiece-side pressure canal 18 is connected to the tube-side pressure canal 16 and therewith forms the coupled pressure canal 20. The variable-volume element 14, in the form of an inflatable balloon, can be supplied with pressure through the coupled pressure canal 20 by using the diagrammatically shown pump system 22. Conversely, the pump system 22 can conduct pressure out of the variable-volume element 14, as a result of which its volume is reduced and it collapses.

An overhang 40 is provided, so that the variable-volume element 14 does not catch in the drill-hole 34 and possibly block it. Preferably, the overhang 40 is affixed as a kind of protection screening or shielding on the earpiece-side coupling element 12 and projects over the drill-hole 34. Visually and functionally it resembles a dome, as is used in many hearing apparatuses. In this way the overhang 40 can intercept a collapsing variable-volume element 14 in such a way that it does not block the coupled pressure canal 20. Another advantage is that the non-inflated variable-volume element 14 is held by the overhang 40 in such a manner that it can be inflated again more easily.

The projection of the overhang 40 on the earpiece-side coupling element 12 moreover forms a trough, in which the pressure element 24, in this case in the form of a clamping ring, can be positioned. The trough protects the clamping ring from slippage.

Figure 5:
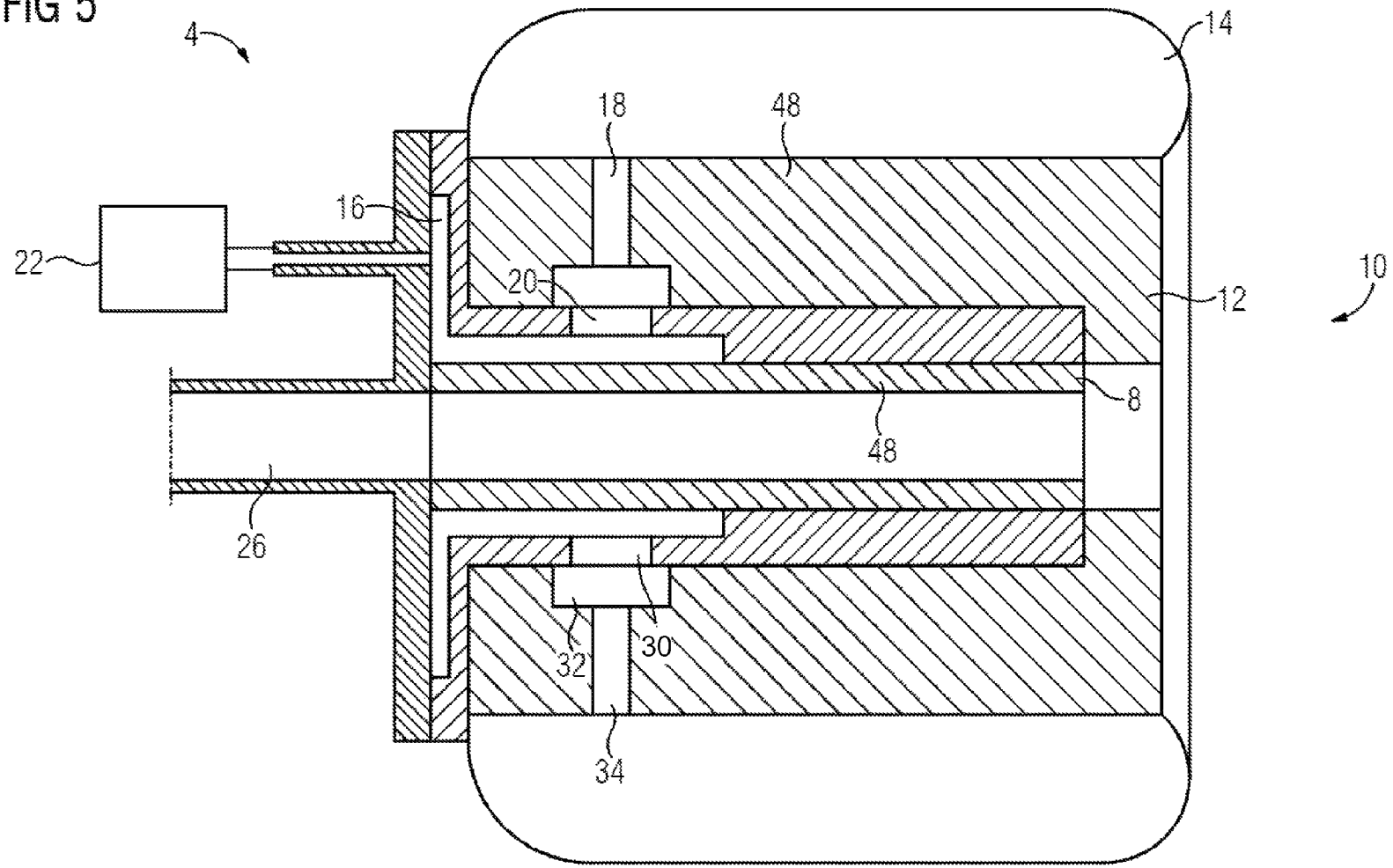
FIG. 5 is a cross-sectional view of an additional embodiment of a hearing apparatus.

FIG. 5 shows another, alternative embodiment of a hearing apparatus 4. In the hearing apparatus, the tube-side coupling element 8 and/or the earpiece-side coupling element 12 themselves have an additional function as a pressure element 48. This assists air-tightness of the coupled pressure canal 20.

The tubular configurations of the two coupling elements are aligned with one another. The earpiece-side coupling element 12 can be pushed onto the tube-side coupling element 8. The tolerances of the dimensions relative to one another are chosen in such a way that a contact pressure of the coupling elements to one another arises in the coupled state. In this way they are connected in a force-locking manner. In other words, for example, in the coupled state the earpiece-side coupling element 12 presses onto the tube-side coupling element 8 in such a way that a slippage of the coupling elements relative to one another is possible only by the effect of external force. Preferably, this should mean that a user can undo the coupling manually. However, when the hearing apparatus is pulled out of an ear the coupling is not undone.

Thus, at least one of the coupling elements additionally acts as a pressure element 48 onto the other coupling element. This improves air-tightness in the region of the coupled pressure canal 20.

Figure 6:
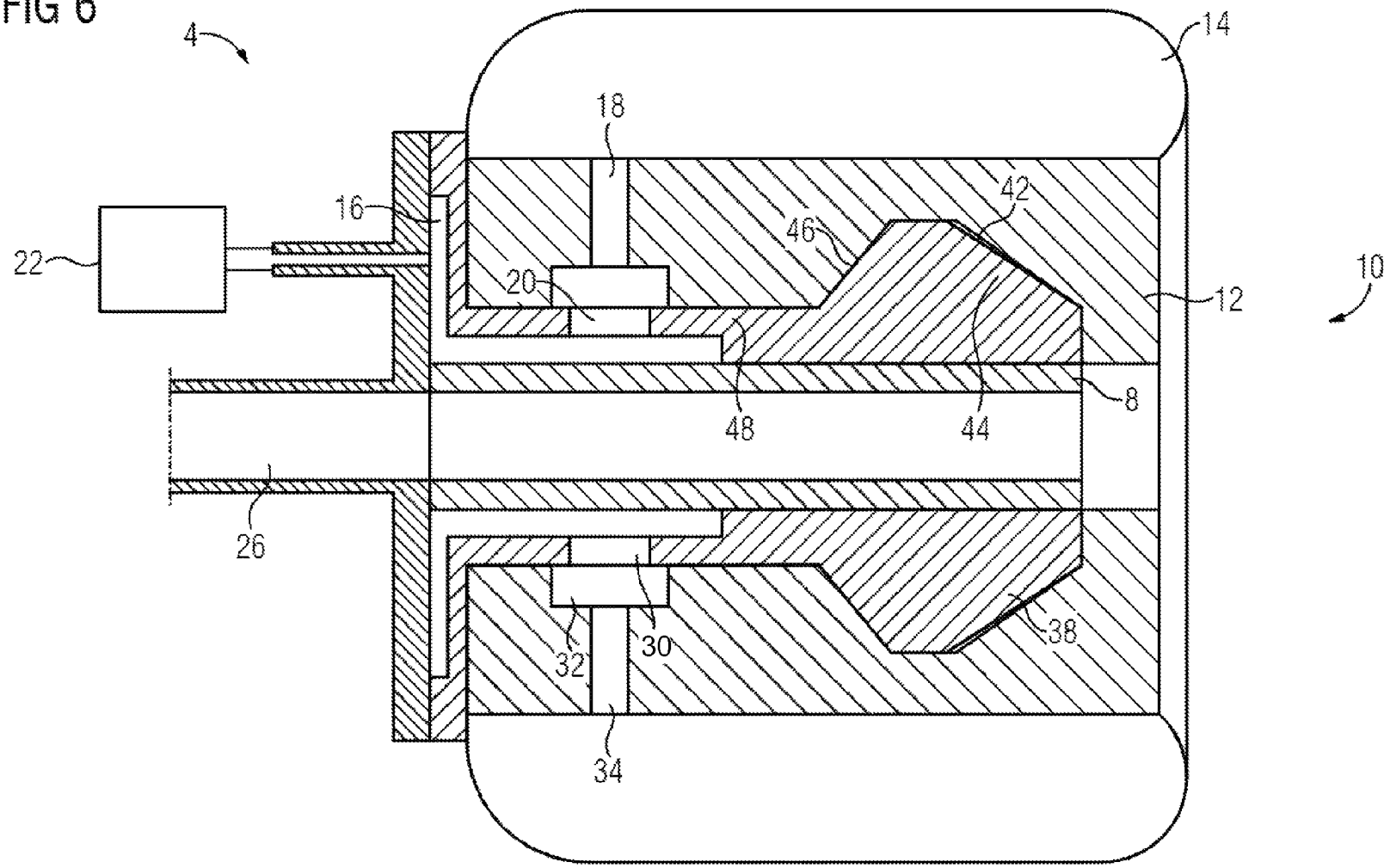
FIG. 6 is a cross-sectional view of yet another embodiment of a hearing apparatus.

In another embodiment, which is shown in FIG. 6, the tube-side coupling element 8 and the earpiece-side coupling element 12 are coupled by using a clip connection 46 in a form-locking manner. Such clip connections provide for one of the coupling elements, in this case the earpiece-side coupling element 12, to have a groove 42. A projecting sprung section 44 of the other coupling element, in this case the tube-side coupling element 8, can latch in the groove 42. Clipping-in the sprung section 44 and associated latching prevents lateral slippage of the coupling elements relative to one another.

Since the sprung section 44 also presses against the earpiece-side coupling element 12 due to its sprung effect, an improved sealing of the coupled pressure canal 20 is additionally achieved. In this embodiment the tube-side coupling element 8 thus has an additional function as a pressure element.

Figure 7:
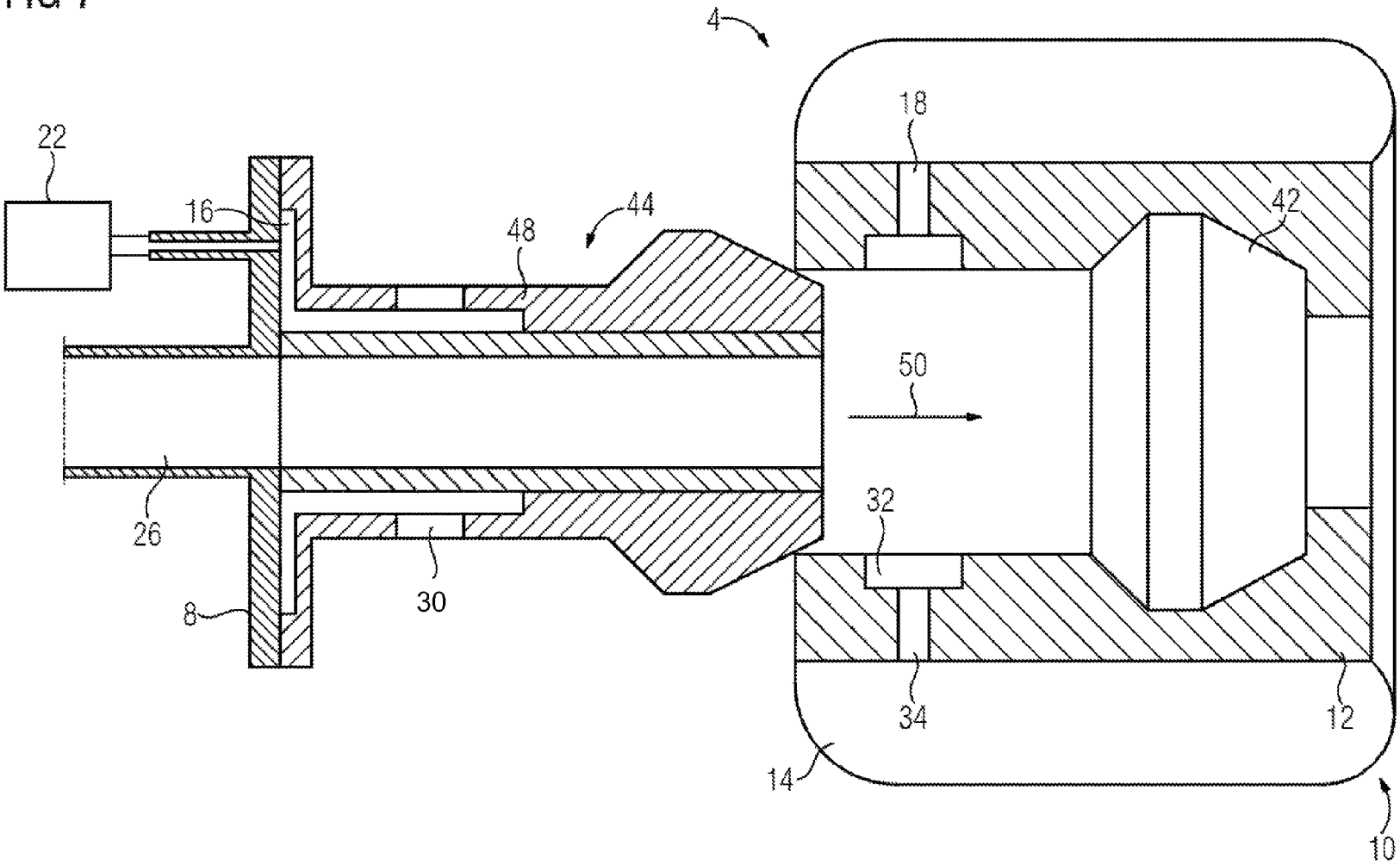
FIGS. 7 and 8 are functional, cross-sectional views of the embodiment according to FIG. 6.
Figure 8:
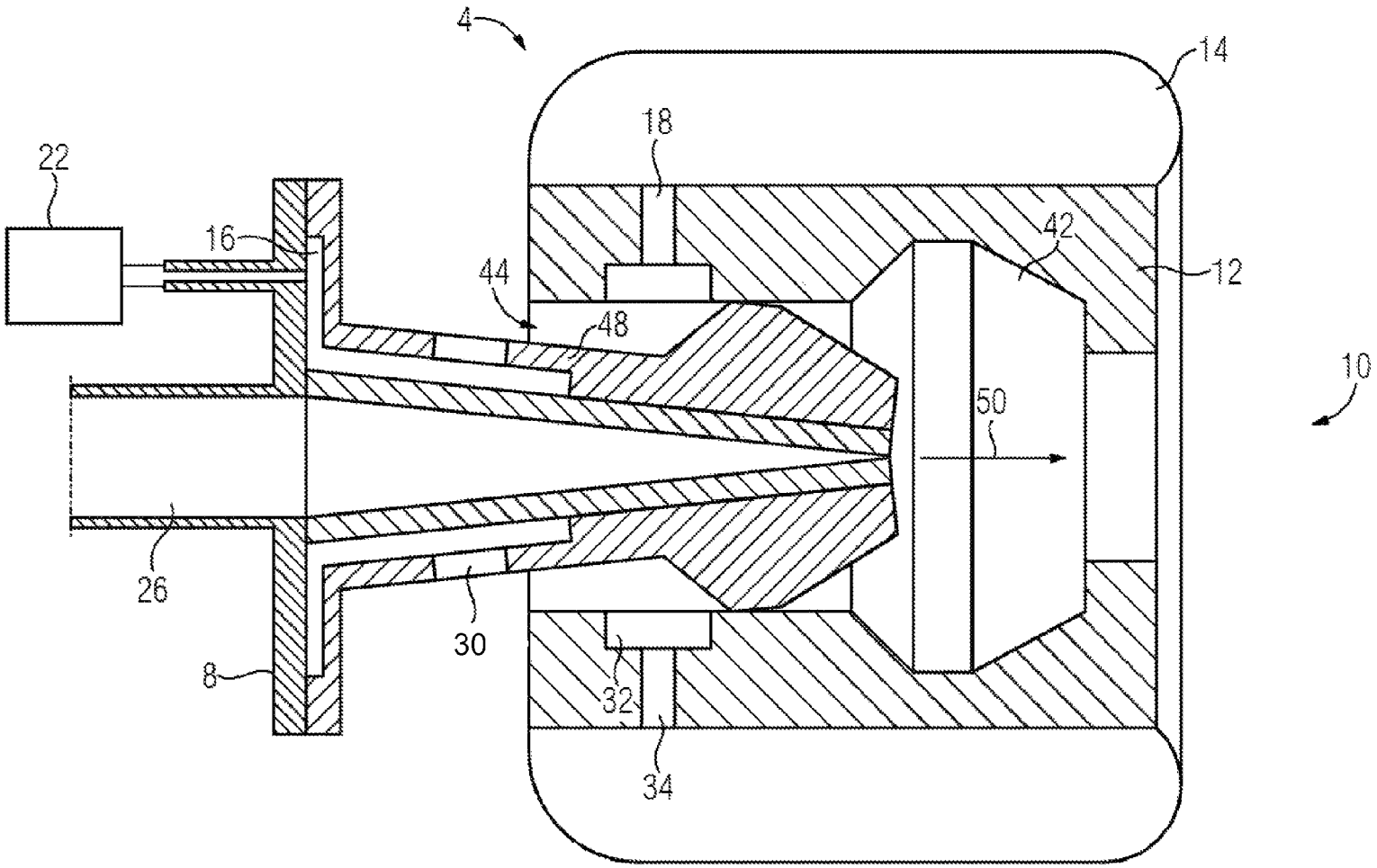

FIGS. 7 and 8 diagrammatically show the functioning of the coupling between the tube-side coupling element 8 and the earpiece-side coupling element 12 of the embodiment of FIG. 6. The figures show how in FIG. 7 the tube-side coupling element 8 is initially guided in the direction of the earpiece-side coupling element 12. The guiding direction is shown by an arrow 50.

When inserting the tube-side coupling element 8 into the earpiece-side coupling element 12 the sprung section 44 is pressed together, until its front region reaches the groove 42, into which it engages and thus forms the clip connection 46. After the engagement, as shown in FIG. 6, the sprung section 44 springs against the earpiece-side coupling element 12 so that it presses against it. A region of the tube-side coupling element 8 thus acts as the pressure element 48. In this way a seal of the coupled air canal 20 is improved.

Furthermore, as can be seen in FIG. 6, the tolerances between the coupling elements are very narrow relative to one another. After coupling, the tube-side coupling element 8 would abut against the earpiece-side coupling element 12 very closely even without the sprung pressure of the pressure element 48. This is necessary so that an optimum air-tightness is present at the coupled region of the coupled pressure canal 20.

The invention claimed is:

1. A hearing apparatus for a hearing device unit, the hearing apparatus comprising:

a sound tube with a tube-side coupling element;

an earpiece with an earpiece-side coupling element;

said tube-side coupling element and said earpiece-side coupling element configured to be reversibly coupled together;

said tube-side coupling element having a tube-side pressure canal and said earpiece-side coupling element having an earpiece-side pressure canal, together forming a coupled pressure canal in a coupled state of said coupling elements;

said earpiece-side pressure canal being at least partly configured as a circumferential groove;

a variable-volume element disposed at said earpiece and having an interior;

said earpiece-side coupling element being rotatable about a rotation axis and having an opening formed therein at an angle relative to said rotation axis, said opening connecting said circumferential groove to said interior of said variable-volume element; and said tube-side coupling element or said earpiece-side coupling element having at least one pressure element promoting air-tightness of said coupled pressure canal.

2. The hearing apparatus according to claim 1, wherein said pressure element has an annular configuration.

3. The hearing apparatus according to claim 1, wherein said pressure element is a clamping element or an expansion element.

4. The hearing apparatus according to claim 1, wherein said pressure element is integrated into said tube-side coupling element or into said earpiece-side coupling element.

5. The hearing apparatus according to claim 1, wherein said tube-side pressure canal includes at least two merging drill-holes.

6. The hearing apparatus according to claim 1, wherein said sound tube and said earpiece each have a respective sound canal acoustically separated from said pressure canals.

7. The hearing apparatus according to claim 1, wherein said variable-volume element has a volume configured to be changed by supplying or removing a medium through said coupled pressure canal.

8. The hearing apparatus according to claim 1, which further comprises an overhang formed on said earpiece-side coupling element and at least partially projecting over an opening of said earpiece-side pressure canal.

9. The hearing apparatus according to claim 1, wherein said tube-side coupling element has at least two assembled components.

10. The hearing apparatus according to claim 9, wherein said at least two assembled components include a first component and a second component manufactured from different materials.

11. The hearing apparatus according to claim 10, wherein said tube-side coupling element and said earpiece-side coupling element are configured and assembled to form a section of said tube-side pressure canal.

12. The hearing apparatus according to claim 1, wherein said tube-side coupling element is manufactured from a metal, at least in vicinity of said coupled pressure canal.

13. The hearing apparatus according to claim 12, wherein said earpiece-side coupling element is manufactured from a rubber or plastic material, at least in vicinity of said coupled pressure canal.

14. A hearing device, comprising a hearing apparatus according to claim 1.

15. The hearing apparatus according to claim 1, wherein said tube-side coupling element and said earpiece-side coupling element are configured to be coupled by a form-locking clip connection.

16. A hearing apparatus for a hearing device unit, the hearing apparatus comprising:

a sound tube with a tube-side coupling element;

an earpiece with an earpiece-side coupling element;

said tube-side coupling element and said earpiece-side coupling element configured to be reversibly coupled together;

said tube-side coupling element having a tube-side pressure canal and said earpiece-side coupling element having an earpiece-side pressure canal, together forming a coupled pressure canal in a coupled state of said coupling elements;

said earpiece-side pressure canal being at least partly configured as a circumferential groove;

a variable-volume element disposed at said earpiece and having an interior;

said earpiece-side coupling element being rotatable about a rotation axis and having an opening formed therein at an angle relative to said rotation axis, said opening connecting said circumferential groove to said interior of said variable-volume element; and said tube-side coupling element or said earpiece-side coupling element themselves configured to perform an additional function as a pressure element promoting airtightness of said coupled pressure canal.

17. The hearing apparatus according to claim 16, wherein said tube-side coupling element and said earpiece-side coupling element are configured to be coupled by a form-locking clip connection.

18. A hearing apparatus for a hearing device unit, the hearing apparatus comprising:

a sound tube with a tube-side coupling element;

an earpiece with an earpiece-side coupling element;

said tube-side coupling element and said earpiece-side coupling element configured to be reversibly coupled together;

said tube-side coupling element having a tube-side pressure canal and said earpiece-side coupling element having an earpiece-side pressure canal, together forming a coupled pressure canal in a coupled state of said coupling elements;

said earpiece-side pressure canal being at least partly configured as a circumferential groove;

a variable-volume element disposed at said earpiece and having an interior;

said earpiece-side coupling element being rotatable about a rotation axis and having an opening formed therein at an angle relative to said rotation axis, said opening connecting said circumferential groove to said interior of said variable-volume element; and said tube-side coupling element and said earpiece-side coupling element being configured to be coupled by a force-locking connection.

* * * * *